United States Patent [19]

Sumi-i et al.

[11] Patent Number: 4,748,147

[45] Date of Patent: May 31, 1988

[54] WRITING SET

[75] Inventors: Masa-aki Sumi-i, Osaka; Hikoshiro Nushimura, Hyogo, both of Japan

[73] Assignee: Sakura Color Products Corp., Higashinari, Japan

[21] Appl. No.: 802,821

[22] Filed: Nov. 29, 1985

[51] Int. Cl.[4] ..... B41M 5/12; B41M 5/16

[52] U.S. Cl. ..... 503/204; 427/152; 503/201; 503/206

[58] Field of Search ..... 346/201, 204, 206; 427/150–152; 503/201, 204, 206

[56] References Cited

U.S. PATENT DOCUMENTS

| | | | |
|---|---|---|---|
| 2,714,074 | 7/1955 | Green | 346/206 |
| 3,363,338 | 1/1968 | Skinner et al. | 346/204 |
| 3,745,672 | 7/1973 | Duskin | 346/206 |
| 3,823,022 | 7/1974 | Thomas | 346/201 |

*Primary Examiner*—Bruce H. Hess

*Attorney, Agent, or Firm*—Howard C. Miskin

[57] ABSTRACT

A writing set comprising a combination of paper printed thereon with two or more coloring bands using two or more types of leuco dye which develop different colors and a writing means which contains a solution of acid materials which develops the color of the leuco dyes.

When characters, pictures, etc. are written on the paper, the colorless leuco dyes in the written portion develop color to form colorful characters, pictures, etc.

7 Claims, 2 Drawing Sheets

WRITING SET

This invention relates to an interesting writing set comprising a combination of writing paper and a writing means which provides by one writing operation colorful characters, pictures, or graphs represented by two or more colors appearing in parallel on the writing paper. (In this specification, "writing" includes also "applying".)

A writing set which develops color by writing on a colorless writing surface is known. However, the color developed by this set is only a single type, giving an unsatisfied feeling in this colorful time.

It is an object of the present invention to provide a writing set which is free of such drawbacks.

The writing means according to the invention permits writing on the paper of the invention two or more characters or pictures in a beautiful color arrangement, graphs or music scores of two or more colors, or, for example, an English sentence and German sentence of parallel in colors different from each other. Thus, the invention provides a writing set both useful and tasteful.

Figure 1:
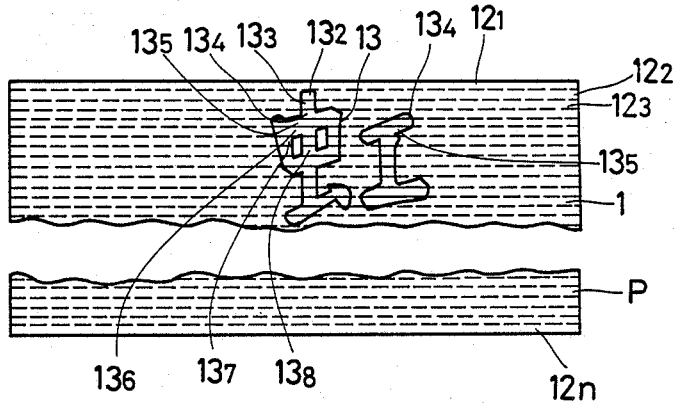

FIG. 1 is a partial plan view showing a first embodiment of the writing paper P according to the invention.

FIGS. 2, 3, 4, 5, and 6 are partial plan views showing 2nd, 3rd, 4th, 5th, and 6th embodiments of the writing paper according to the invention, respectively.

Figure 7:
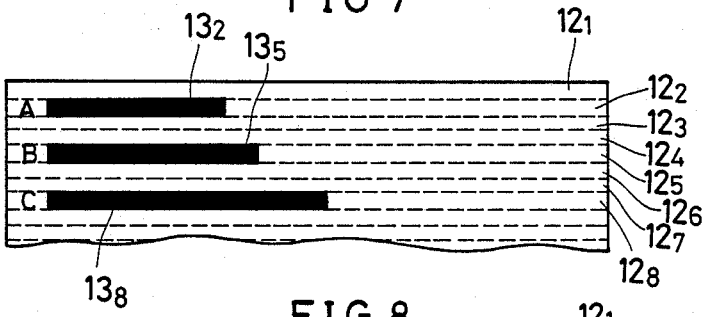
Figure 8:
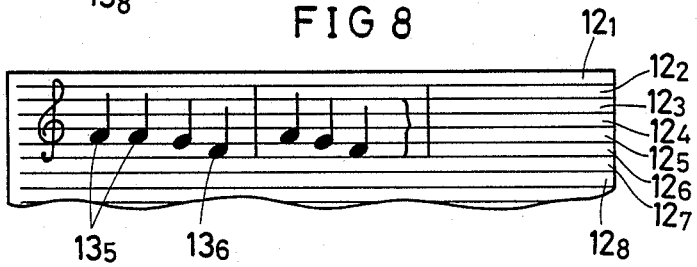
Figure 9:
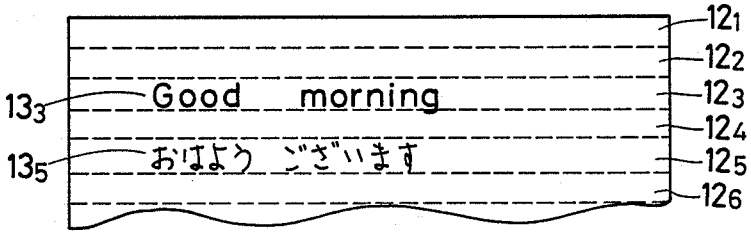

FIGS. 7, 8, and 9 are partial plan view showing the usage of the paper of the invention.

Figure 10:
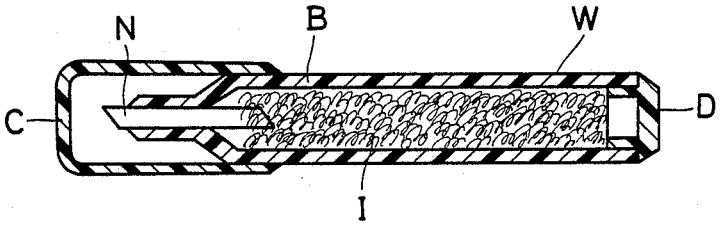

FIG. 10 is a longitudinal section showing the writing means according to the invention.

In FIG. 1, numeral 1 represents the writing paper according to the invention. This paper, which is to be soaked with a leuco dye solution as described later, preferably has some permeability. Equivalent effects are achieved with fine quality paper, drawing paper, and Japanese paper as well as nonwoven fabric and cloth.

Numerals $2_1$, $2_2$, $2_3$, . . . $2_n$ represent two ore more color bands formed by applying or printing linearly on paper 1 leuco dye solutions which develop colors different from each other. They are initially colorless, but develop colors when characters, pictures, etc. are written on the paper with an acidic solution which makes the leuco dyes develop colors. If bands $2_1$, $2_2$, $2_3$, $2_4$, $2_5$, $2_6$, and $2_7$ are applied so as to develop red, orange, yellow, yellow-green, green, blue, and purple, respectively, an interesting color arrangement like a rainbow can be obtained.

Numeral 2 represents a character written by using the writing means according to the invention, $3_2$, $3_3$, $3_4$, $3_5$, $3_6$, $3_7$, and $3_8$ representing parts developed into orange, yellow, yellow-green, green, blue, purple, and red, respectively.

Leuco dyes for producing the above colors are shown in the Table given below.

| Color | Leuco dye |
|---|---|
| Red | Rhodamine Lactam |
| Orange | 3-methylamino-6-chlorofluoran |
| Yellow | 3,6-diethoxyfluoran |
| Yellow-green | 3,6-diethoxyfluoran and Malachite Green lactone |
| Green | Malachite Green lâctone |
| Blue | Crystal Violet lactone |
| Purple | 2-diethylaminobenzofluoran |

As the fixing agent of the leuco dyes, usually a solution of an oil soluble resin such as ethyl cellulose, nitrocellulose, polyvinyl butyral, rubber chloride, rosin, and petroleum resin in organic solvent is used.

Figure 2:
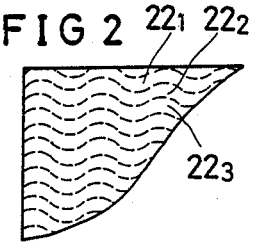

In the 2nd embodiment shown in FIG. 2, parallel color bands $22_1$, $22_2$, $22_3$, . . . depict sine curves, unlike the 1st embodiment.

Figure 3:
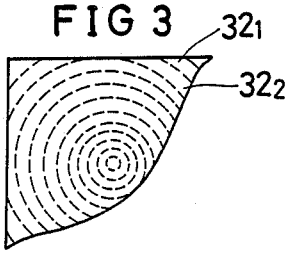

In the 3rd embodiment in FIG. 3, the parallel color bands $32_1$, $32_2$, $33_3$, . . . form concentric circles.

Figure 4:
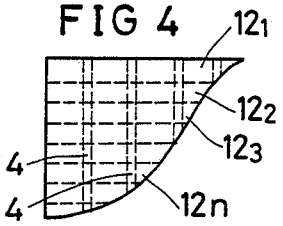

In the 4th embodiment in FIG. 4, parallel color bands $12_1$, $12_2$, $12_3$, . . . are linear as in the 1st embodiment, but they include blank bands 4 which are free of the dye solution at given intervals.

Figure 5:
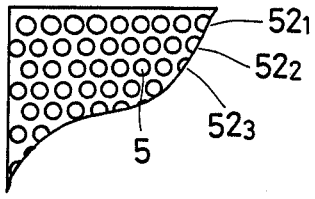

In the 5th embodiment in FIG. 5, parallel color bands $52_1$, $52_2$, $52_3$, . . . consist of circles 5 arranged linearly. Alternatively, the circles may assume any shape such as hexagons, star marks, cat heads, or elephant figures.

Figure 6:
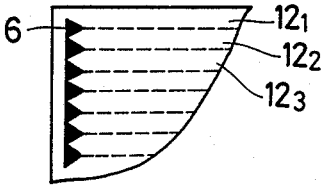

In the 6th embodiment in FIG. 6, parallel color bands $12_1$, $12_2$, $12_3$, . . . are linear like in the 1st embodiment, but marks showing the boundaries of each color band are provided at the left end. In this embodiment, they are triangles, but any figure such as diamond, arrow, fingertip, or other marks showing a point may be used.

The effects of the invention are now described.

In FIG. 1, a beautiful character of seven colors was obtained by one touch of the writing means on the writing paper. Instead of characters, pictures having a design effect may be obtained similarly. To expect this effect, any of the embodiments from 1st to 6th can be used.

FIG. 7 shows a 2nd application which uses the writing paper for the preparation of a graph. For showing the sales amount of salesmen A, B, and C, for example, if A is shown by orange $13_2$, B by green $13_5$, and C by red $13_8$, a beautiful and clear display is possible. To expect such provide the 1st and the 4th to 6th embodiments can be used, and the 6th is particularly convenient since the lining position for bar graph can be accurately shown.

FIG. 8 shows a 3rd example of use which can express music scores with a variety of color development such as "mi" by green $13_5$, "re" by green and blue, and "do" by blue $17_7$.

Finger 9 shows a 4th example of use, in which language is studied by comparing English and Japanese. In this example, English is shown by yellow $13_3$, and Japanese by green $13_5$. This expression permits pleasant study of language, accordingly, increased learning efficiency.

The 3rd and 4th examples of use, as well as the 2nd example, can use the 4th to 6th embodiments, among which the 6th is preferable because it permits accurate confirmation of the position.

FIG. 10 is a longitudinal section of the writing means W according to the invention, in which B is an axial cylinder B made of plastics or aluminum with drawn end and closely fitted with a penpoint N made of felt, fiber bundle, or synthetic resin. In the axial cylinder, absorber I for occuluding liquid is inserted. C is a cap, and D is a tail stopper.

The absorber I occludes a solution of acidic substances such as bisphenol A, p-oxibenzoic acid, zince salicylate, p-toluensulfonic acid, hydroquinone, and gallic acid. In this embodiment, the structure of a marking pen is exemplified, but any type of writing means such as fountain pen and ballpoint pen can be used as far as it contains an acid solution.

When characters, pictures, graphs, etc. are written on the writing paper using the writing means according to the invention, the acid solution in the writing means reacts with the leuco dyes in the paper to develop expected colors.

Thus, in the case of FIG. 1, characters or pictures colored by parallel lines of seven type of color appear. In the embodiment of FIG. 7, colorful graphs result, in FIG. 8 colorful and delightful music scores are obtained, and in the case of FIG. 9, a delightful language learning experience is achieved.

What is claimed is:

1. A combination writing device comprising a sheet substrate having printed thereon a plurality of proximate areas of different color leuco dyes in an undeveloped colorless state and a writing instrument containing a dye developing composition including and acid solution whereby when said writing instrument is drawn over said substrate along any desired path said dyes are developed along said path in accordance with the traversed dye areas to produce correspondingly colored image of said path.

2. The combination of claim 1 wherein said proximate dye areas are contiguous bands of said undeveloped leuco dyes.

3. A writing set as claimed in claim 2 wherein said bands are linear.

4. A writing set as claimed in claim 2 wherein said bands form wavy curve.

5. A writing set as claimed in claim 2 wherein said bands form concentric curves.

6. A writing set as claimed in any of claims 2 to 5 wherein said bands are printed with solutions of said undeveloped leuco dyes all over the surface of paper.

7. A writing set as claimed in any of claims 2 to 5 wherein a mark is attached to each boundary of parallel bands.

* * * * *